US005667060A

United States Patent [19]

Luzzi

[11] Patent Number: 5,667,060

[45] Date of Patent: Sep. 16, 1997

[54] DIAPHRAGM SEAL FOR A HIGH VOLTAGE SWITCH ENVIRONMENT

[75] Inventor: Glenn J. Luzzi, Mt. Bethel, Pa.

[73] Assignee: Amerace Corporation, Hackettstown, N.J.

[21] Appl. No.: 578,144

[22] Filed: Dec. 26, 1995

[51] Int. Cl.[6] ..... H01H 9/04

[52] U.S. Cl. ..... 200/302.1; 200/537; 200/538; 200/540

[58] Field of Search ..... 200/303.1, 303.2, 200/537, 538, 539, 540, 541, 542

[56] References Cited

U.S. PATENT DOCUMENTS

| | | | |
|---|---|---|---|
| 2,744,984 | 5/1956 | Hults | 200/168 |
| 2,794,101 | 5/1957 | Jennings | 200/538 |
| 2,853,584 | 9/1958 | Upton, Jr. | 200/149 |
| 2,995,639 | 8/1961 | Panerai et al. | 200/168 |
| 3,244,015 | 4/1966 | Parris, Jr. | 200/539 |
| 3,941,957 | 3/1976 | Tilman | 200/82 R |
| 4,215,253 | 7/1980 | Tilman | 200/82 R |
| 4,230,922 | 10/1980 | Habecker | 200/302.2 |
| 4,709,126 | 11/1987 | Miller et al. | 200/83 P |
| 4,877,930 | 10/1989 | Kukuma | 200/302.2 |
| 4,894,497 | 1/1990 | Lycan | 200/83 R |
| 5,216,213 | 6/1993 | Sato | 200/83 R |

*Primary Examiner*—David J. Walczak
*Attorney, Agent, or Firm*—David Teschner, Esq.

[57] ABSTRACT

A diaphragm for the contact insulating housing of a mechanically operated high voltage switch. The diaphragm has a central portion through which the shaft from the mechanical operating mechanism to the movable contact passes. The walls of the diaphragm about the central portion are mechanically joined or chemically bonded to the shaft. The diaphragm is made of such materials, is dimensioned and configured so that the diaphragm moves with the shaft and prevents relative motion therebetween. The outer rim of the diaphragm is mechanically joined or chemically bonded to the switch housing. The quality of the diaphragm and the seals permits them to withstand the application of the full operating voltage of the switch.

46 Claims, 5 Drawing Sheets

DIAPHRAGM SEAL FOR A HIGH VOLTAGE SWITCH ENVIRONMENT

CROSS-REFERENCE TO RELATED APPLICATION

Application for U.S. patent Ser. No. 08/578,038 filed Dec. 26, 1995 entitled "High Voltage Switches" by Glenn J. Luzzi and Ser. No. 08/578,040 filed Dec. 26, 1995 entitled "Switch Activator" by Lloyd B. Smith both assigned to the assignee of the instant application.

BACKGROUND OF THE INVENTION

1. Field of the Invention

The invention is directed to the field of electrical switches and more particularly to an electrical switch whose contacts are located within an insulating environmental enclosure operated by a mechanical system outside of the enclosure connected by a shaft extending through an enclosure seal.

2. Description of the Prior Art

In existing systems, the use of a reciprocating or rotating shaft extending through a seal into an insulating environment such as oil, SF or vacuum, can, due to wear of the seal adjacent such a shaft, permit the insulating media to leak out of the enclosure or permit air to enter the enclosure and destroy the vacuum and thus destroy the switch insulation. So as not to interfere with the movement of the operating shaft the seals had to be relatively thin and flexible and could not be located where it was possible to have the entire system voltage applied to them. This made the overall switch and operating device complex and quite large. To prevent loss of the insulating environment through a faulty seal the entire switch, including contacts and operating mechanisms could be placed in a large sealed chamber. However, this severally limited the possible locations for such a switch and often resulted in a location far from the system to be protected.

SUMMARY OF THE INVENTION

The present invention overcomes the difficulties noted above with respect to prior art devices by providing electrical contacts within an insulating environmental enclosure, a mechanical operating system external to the enclosure and connected by an operating shaft through an enclosure seal or diaphragm which permits movement of the shaft without injury to the seal itself and which can withstand the application of the system voltage to it. The seal is chemically or mechanically joined to the shaft in such a manner that there is no relative motion between the seal and the shaft and the seal flexes in direct response to shaft motion. At one end, the shaft is connected to a movable contact within the enclosure. The other end of the shaft is connected to a mechanical operating mechanism. The seal or diaphragm can be molded as a part of the insulating environmental enclosure or it can be molded or otherwise formed separately and coupled to the enclosure by mechanical or chemical means such as retaining rings or bonding. It is an object of the instant invention to provide a novel seal for an insulating environmental enclosure having a moveable assembly therein.

It is an object of the instant invention to provide a novel seal or diaphragm which permits the contacts of a high voltage electrical switch to be located in an insulating environmental enclosure while the mechanical operating mechanism is outside of such enclosure.

It is another object of the instant invention to provide a novel mechanically operated electrical switch which permits the contacts of a medium to high voltage electrical switch to be located in an insulating environmental enclosure while the mechanical operating mechanism is outside of such enclosure and connected to said contacts by an operating shaft that extends through an enclosure seal.

It is still another object of the instant invention to provide a seal for an insulating environmental enclosure which is joined to reciprocally moved operating shaft without relative movement between such seal and shaft.

It is yet another object of the instant invention to provide a seal for an insulating environmental enclosure which is joined to a reciprocally moved operating shaft and which flexes with the movement of such shaft.

It is another object of the instant invention to provide a novel mechanically operated electrical switch which permits the contacts of a medium to high voltage electrical switch to be located in an insulating environmental enclosure while the mechanical operating mechanism is outside of such enclosure and connected to said contacts by an operating shaft that extends through an enclosure seal.

It is still another object of the instant invention to provide a novel seal for an insulating environmental enclosure which is joined to a reciprocally moved operating shaft without relative movement between such seal and shaft.

It is yet another object of the instant invention to provide a novel seal for an insulating environmental enclosure which is joined to a reciprocally moved operating shaft and which flexes with the movement of such shaft.

It is another object of the instant invention to provide a novel seal for an insulating environmental enclosure which is joined to a reciprocally moved operating shaft by chemical means and which flexes with the movement of such shaft.

It is still another object of the instant invention to provide a novel seal for an insulating environmental enclosure which is joined to a reciprocally moved operating shaft by mechanical means and which flexes with the movement of such shaft.

Other objects and features of the invention will be pointed out in the following description and claims and illustrated in the accompanying drawings, which disclose, by way of example, the principals of the invention, and the best modes which are presently contemplated for carrying them out.

BRIEF DESCRIPTION OF THE DRAWING

In the drawings in which similar elements are given similar reference characters.

DESCRIPTION OF THE PREFERRED EMBODIMENTS

Figure 1:
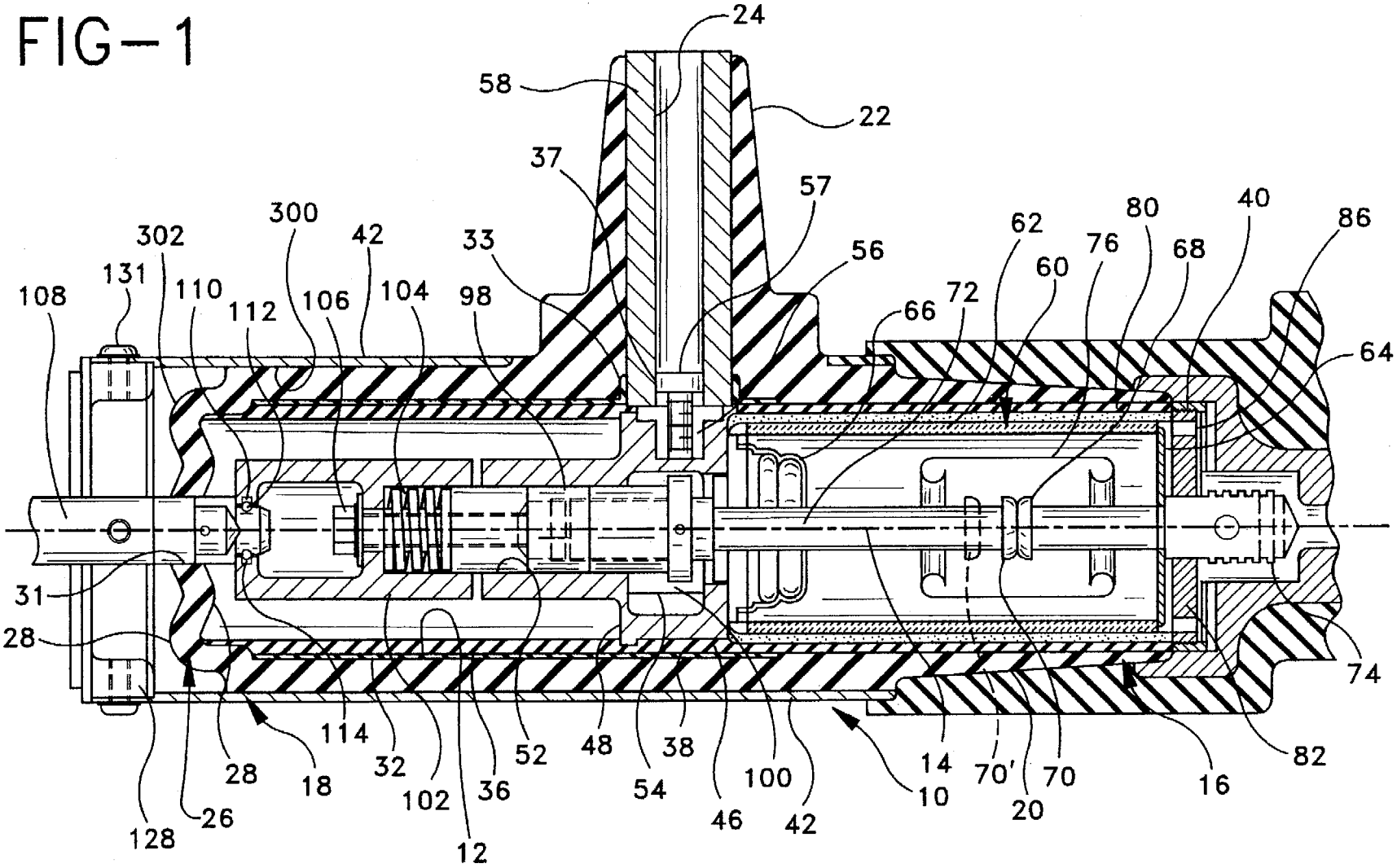
FIG. 1 is a fragmentary, side elevational view, partly in section, of a high voltage switch showing the position of one embodiment of a seal or diaphragm, constructed in accordance with the concepts of the invention, with respect to such switch.

Turning now to FIG. 1, there is shown a high voltage switch, of the type generally used in the 3 KV to 38 KV voltage range. The switch has a housing portion 10 formed from a dielectric elastomer such as ethylene propylene diene monomer (EPDM) elastomer, natural or synthetic rubber or the like. About housing portion 10 is an exterior support shell 42 formed of a rigid electrical conductive material such as stainless steel. Formed with a void free interface, a semi-conductive layer 32 lines the bore 12 of housing portion 10. The layer 32 is made of the same EPDM material as the housing portion 10 with the addition of a conductive material such as carbon black. Within conductive insert 32 is formed a rigid, tubular reinforcing element 36 which extends substantially the entire length of housing portion 10. This element 36 is fabricated from a dielectric material having a high physical strength.

A contact assembly 60, between an operating end buttress 46 and fixed end 16 has a fixed contact 68 and a movable contact 70 and a bottle 62 about it. The solid lines show movable contact 70 in the closed position while the dotted lines show contact 70, identified as 70', in the open position. The bottle 62, of ceramic or other similar materials, has a metallic fixed end closure 64 and an operating end closure 66 which includes a flexible, extensible metallic bellows. The moveable contact 70 is connected by a rod-like operating element 72 disposed on the outside of bellows and constitutes an extension of movable contact 70. The contacts 68 and 70 are surrounded by a metallic shield 76 and the bottle 62 is hermetically sealed.

The interior of the bottle is a controlled atmosphere and may contain an arc-suppressing gas such as $SF_6$. The exterior of the bottle 62 is insulated by a dielectric filler 80 which occupies the space between the exterior of bottle 62 and the interior of reinforcing element 36.

The operating element 72 is connected to a slideable link 98, which in turn is connected to a yoke 102. A bolt 106 and a coil compression spring 104 insure that the movement of yoke 102 is applied to slideable link 98 and thence to the moveable contact 70. Yoke 102, in turn, is connected to an actuating shaft 108 by a resilient snap ring 114 which is engaged in groove 112 on shaft 108 and a groove 110 in the end wall of yoke 102. The shaft 108 is connected to a driver assembly, as is shown and described the above cited copending application. Placed in the end of exterior support element 42 is an annular collar 128 sized so that it fits within the support element 42 and is attached to support element 42 by fasteners 131 which may be machine screws, self-taping metal screws, rivets or the like.

Figure 2:
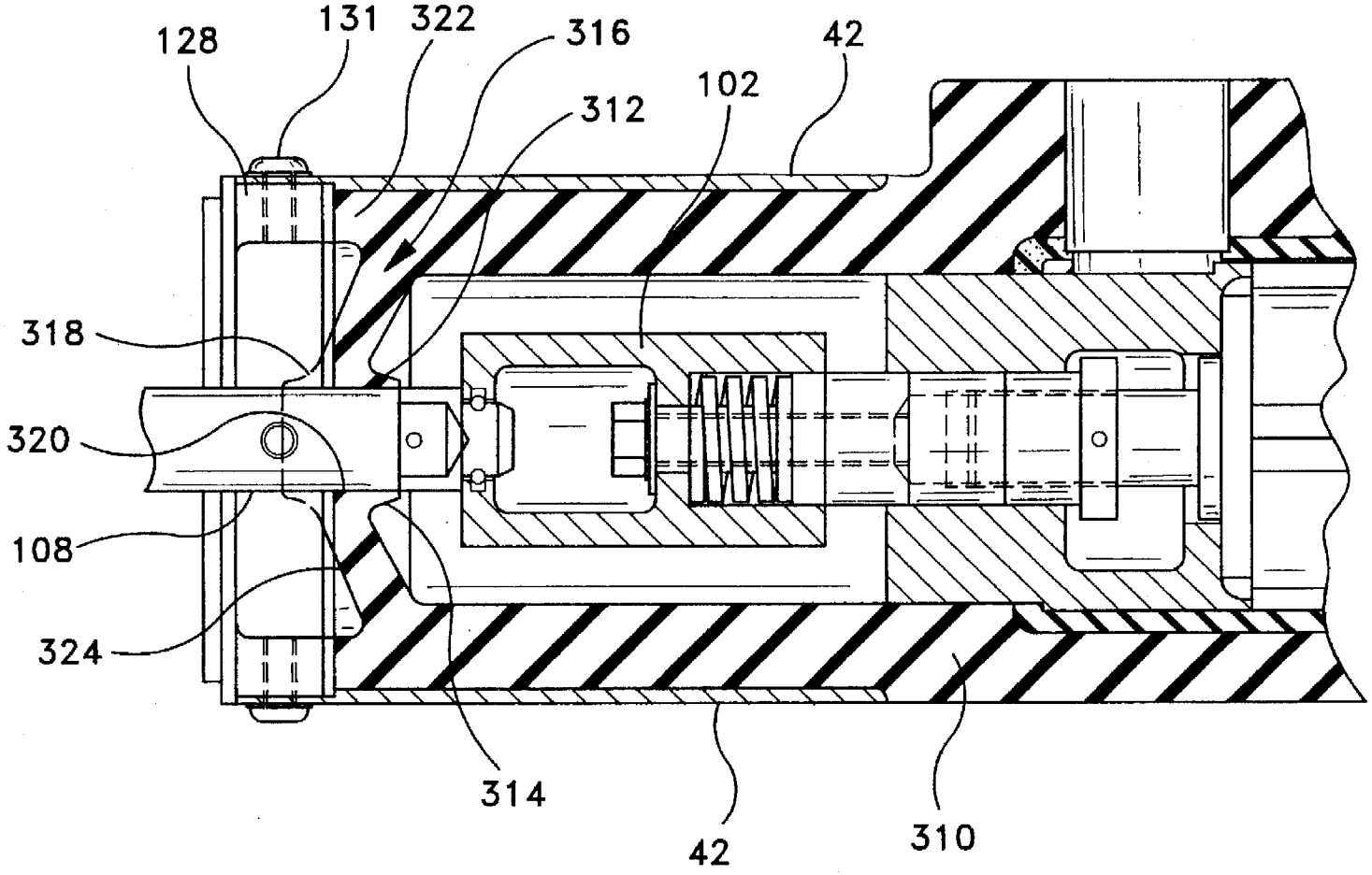
FIG. 2 is a fragmentary, side elevational view, partly in section, of a high voltage switch showing the position of a second embodiment of a seal or diaphragm, constructed in accordance with the concepts of the invention, with respect to such switch.
Figure 3:
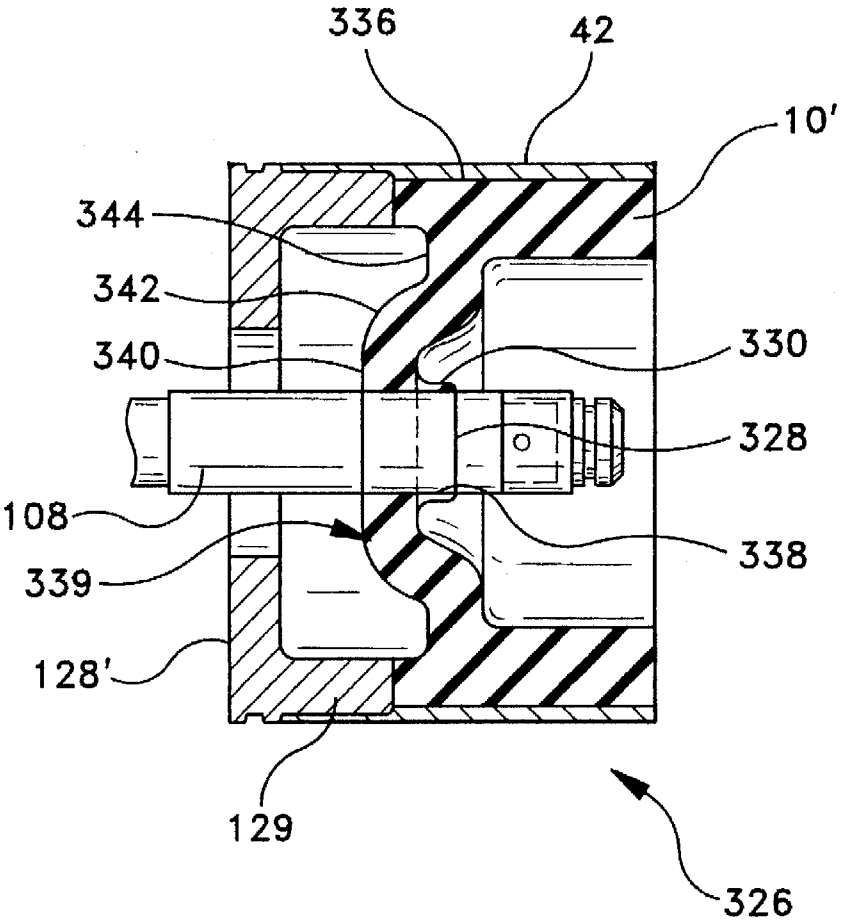

To seal the end 18 of housing portion 10 while permitting actuating shaft or element 108 to enter the housing portion 10 a seal or diaphragm 26 is employed. The seal or diaphragm 26 is molded from the same type of EPDM elastomer as the housing portion 10 and may be molded at the same time and as a portion of the housing portion 10 as is shown in FIGS. 1, 2 and 3 or it may be molded as a separate part and bonded or otherwise joined to the housing portion 10. The seal or diaphragm 26 has an aperture 31 at its center 30 and may include a hub which extends along the surface of element 108 away from the main body of seal or diaphragm 26. The walls defining aperture 31 may be chemically or mechanically joined to element 108 and does not permit relative movement therebetween. Thus the destructive forces of the environment and movement of element 108 do not cause enlargement of the aperture 31 by constant linear or rotational movement which can wear the seal or diaphragm and cause its failure as is true in prior art devices.

The body of diaphragm 26 between its center 30 and its outer rim can be corrugated as shown in FIGS. 1, 4, 6, 7, and 8, can be linear as in FIG. 2 or a combination of linear and curved portions as shown in FIG. 3.

Turning now to FIG. 1, the diaphragm 26 is molded as a portion of housing portion 10 and is thus made of an insulating EPDM elastomeric. An outer edge 300 is in contact with the interior surface of exterior support element 42 and is bonded to element 42 using a chemical bonding agent such as the bonding agent sold under the trademark Chemlok 205 and, if desired, with well known conventional adhesion promoting agents. The aperture 31 is intentionally made smaller than the outer diameter of actuating element 108 so that the material about aperture 31 is stretched and will firmly grip the external perimeter of element 108. The joint between the external perimeter of element 108 and the walls about aperture 31 are also chemically bonded. The seal or diaphragm 26, body 302 is formed as a series of corrugations 28 which extend from center aperture 31 towards outer edge 300. The corrugations 28 can expand or contract as the element 108 moves so as not to impede the movement of element 108.

The joints between outer edge 300 of diaphragm 26 and support element 42 and between diaphragm 26 about aperture 31 and actuating element 108 as well as the diaphragm 26, itself, must have full voltage withstand capabilities. This means that seal or diaphragm 26 must be made of a material, have a thickness and uniformity of material, and the joints of diaphragm with the support element 42 and element 108 must be able to withstand the maximum voltage to be impressed between the current-carrying elements of the switch and ground during service or during fault conditions. For example, in a switch intended to operate at nominal 25 KV phase to phase, the diaphragm and seals must be able to withstand about 14.4 KV continuously.

In FIG. 2 the diaphragm 316 is molded as a part of housing portion 310. Central portion 312 has hubs 314 and 318 formed about it to provide for increased surface contact with the actuating shaft 108. Central aperture 320 extends through central portion 312 as well as hub 314 and hub 318 adjacent collar 128. A rim 322 extends beyond the body 324 and engages collar 128 to provide more insulation adjacent support 42. Body 324 is linear between central portion 312 and the outer surface in contact with exterior support element 42 and is inclined outwardly from central portion 312 towards element 42. As actuating element 108 moves to the right in FIG. 2, to move movable contact 70 into engagement with fixed contact 68, as shown in FIG. 1, the body 324 is compressed. It expands to its former configuration as the moveable contact 70 returns to the open position.

FIG. 3 shows a diaphragm 326 having a central portion 328 and a hub 330 extending inwardly towards the position of yoke 102 (not shown). Diaphragm 326 has a single hub 330 also extending inwardly and a rim 336 to engage the inwardly facing arms 129 of collar 128. Aperture 338 extends through central portion 328 and hub 330. Body 339 is made up of two linear portions 340, 344 with a curved portion 342 between them. The diaphragms 316 and 326 are each chemically bonded to actuating element or shaft 108.

Figure 4:
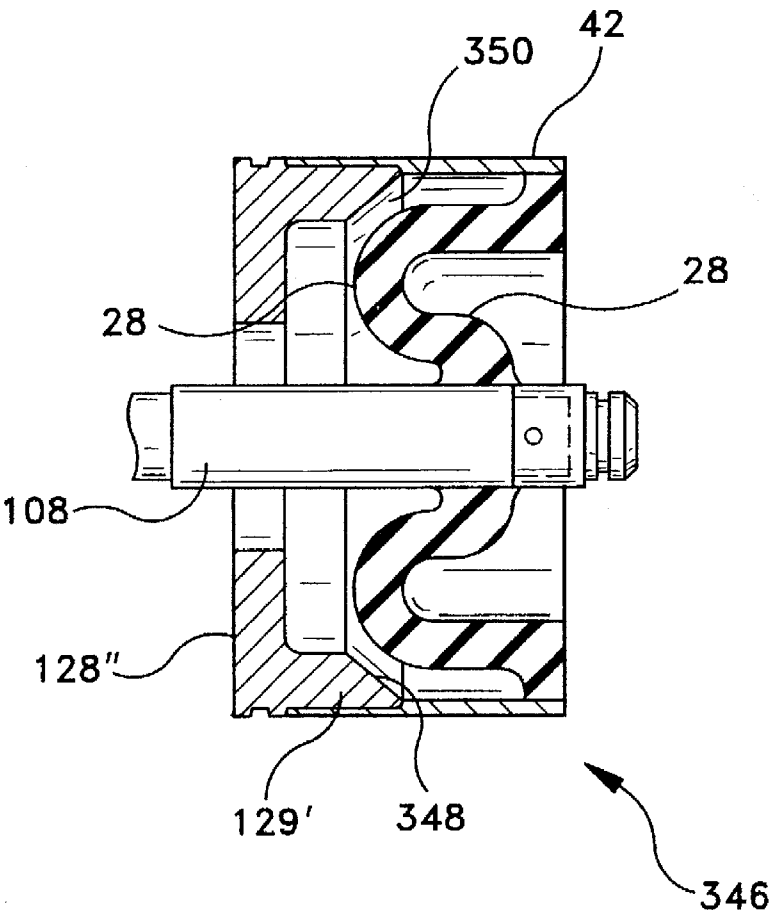
FIGS. 3 to 8, are side elevational views, partly in section, of alternative embodiments of seals or diaphragms constructed in accordance with the concepts of the invention.

The seal or diaphragm 346 of FIG. 4 is similar to that shown in FIG. 1 except that it is separately molded and then bonded to the housing portion and the exterior support element 42. The edges of inwardly facing arms 129' are tapered as at 348 to provide a space 350 to accommodate the diaphragm 346 as element 108 moves to the left in FIG. 4. Diaphragm 346 is also chemically bonded to element 108.

Figure 5:
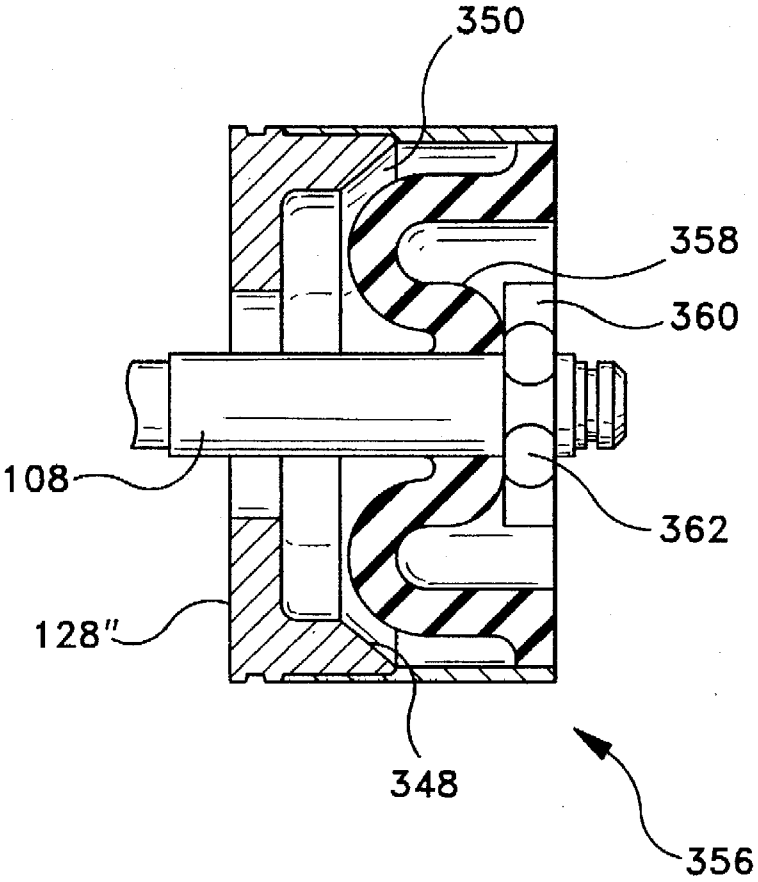

FIG. 5 shows a diaphragm 356 similar to diaphragm 346 of FIG. 4 except that diaphragm 356 has a hub 358 extending in the forward direction towards yoke 102. Hub 358 has crimpable ring 360 placed about it and the ring 360 is crimped using a suitable tool and dies as is well known in the art. Upon the completion of the crimping operation, the ring 360 will have flats 362 on its outer surface. The ring 360 could also be compressed upon hub 358 and element 108 by swaging, indenting and other similar operations to decrease the interior diameter of ring 360.

Figure 6:
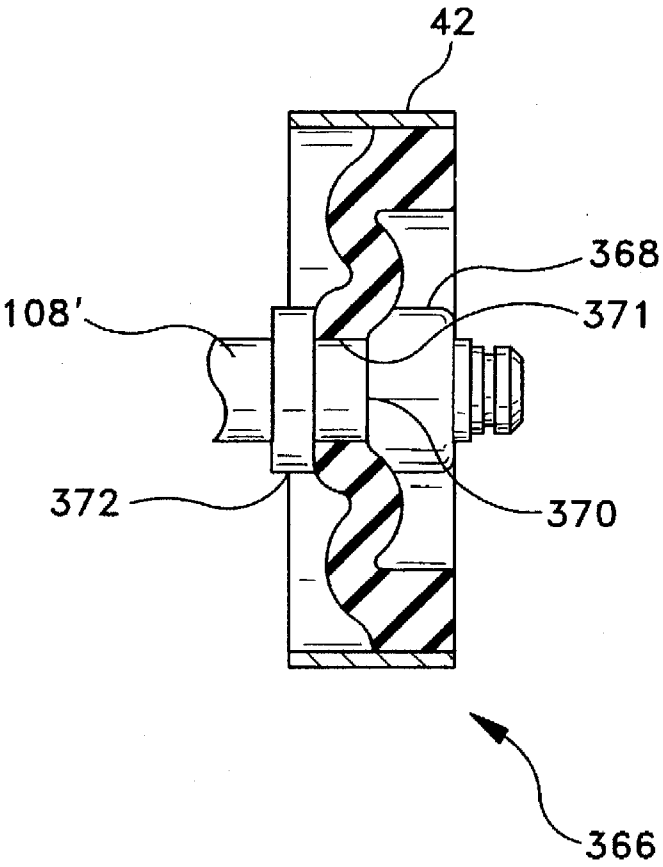

To mechanically cause the engagement of diaphragm 366 of FIG. 6 with the actuator element 108', the actuator element 108' can be modified to have a raised annular shoulder 368 which bears upon the front surface of diaphragm 366 adjacent the central portion 370. A jam nut 372 can be applied against the opposite face of diaphragm 366. The effect of tightening the jam nut 372 on the threaded portion of element 108' (not shown) is to force the diaphragm 366 against shoulder 368 and compress the diaphragm and cause the walls defining aperture 371 to tightly grip the outer surface of element 108'. The jam nut 372 could be replaced with a crimpable ring or the like. Seal 366 is also molded independently and is bonded to the housing portion 10 and the support element 42.

Figure 7:
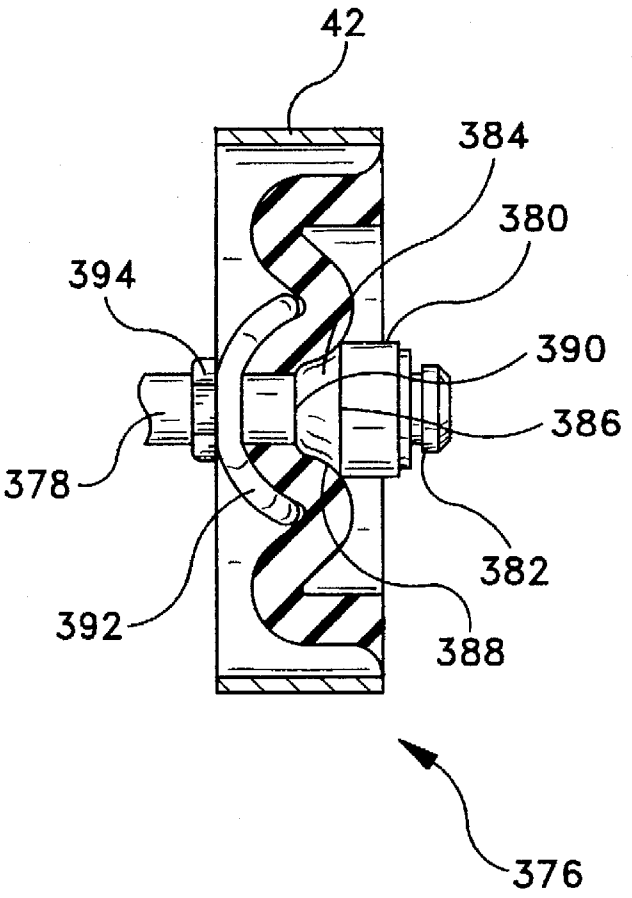

FIG. 7 shows a diaphragm 37 6 which is mechanically joined to an actuator element 378 and is only bonded to the housing portion 10 (not shown). Actuator element 378 has an annular shoulder 380 adjacent end 382. Shoulder 380 bears against flat surface 386 of a washer 384 whose curved surface 388 conforms to central portion 390 of diaphragm 376. A second washer 392; having a surface that conforms to the rear surface of central portion 390 is forced against diaphragm 376 by the jam nut 394. The aperture through central portion 390 is thus made to decrease in diameter and grip element 378.

Figure 8:
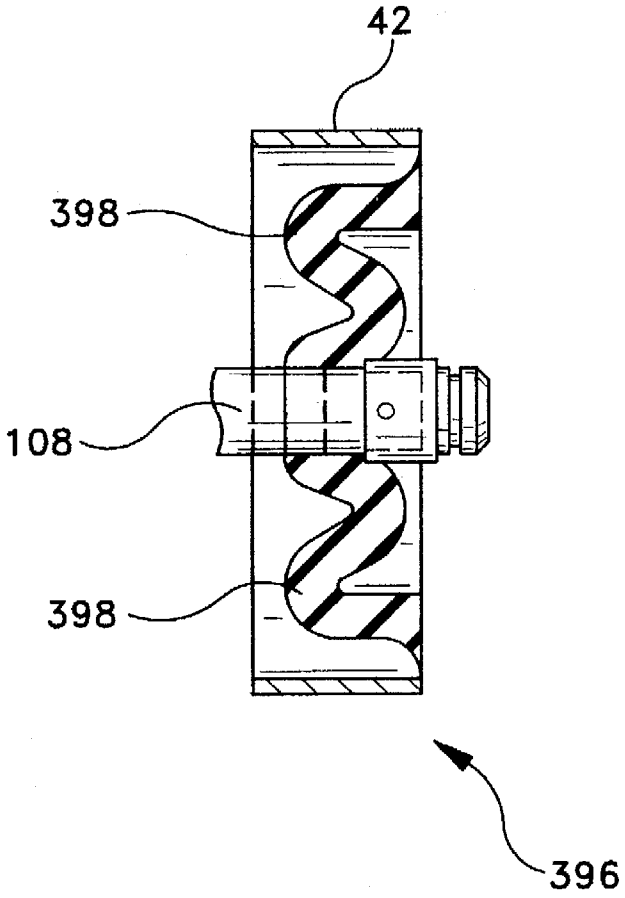

FIG. 8 shows a diaphragm 396 which is chemically bonded to element 108 and only housing portion 10 (not shown). Diaphragm 396 is similar to diaphragm 26 of FIG. 1 but has corrugations 398 that are longer along the length of element 108 than corrugations 28 of diaphragm 26. This reduces the amount of movement of the corrugations 398 compared to corrugations 28 when element 108 is moved.

As can be clearly seen from the seals or diaphragms shown, the seals or diaphragms can be molded as part of the overall insulation of the electrical switch, can be molded separately and bonded to the insulating layer and the interior of the outer conductive support layer, can be chemically bonded or mechanically joined to the actuating shaft which passes through a bore in the central portion and can have a body portion made up of linear segments, curved segments and a combination of linear and curved segments. The material from which the seal or diaphragm is made and its thickness as well as the joints between the diaphragm and shaft and diaphragm and housing of the switch must be such that withstands the full operating voltage of the electrical system.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A mechanically operated high voltage electrical switch comprising:

a) a switch body having a first end and a second end and a central bore therethrough;

b) a first contact member adjacent said body first end for connecting a first high voltage electrical cable thereto;

c) a second contact member intermediate said body first and second ends for connecting a second high voltage electrical cable thereto;

d) a fixed first electrical contact in said central bore adjacent said body first end and coupled to said first contact member;

e) a moveable second electrical contact in said central bore intermediate said first and second ends and coupled to said second contact member, in linear alignment with said fixed first electrical contact, said first and said second contact members and said moveable second electrical contact capable of being moved between a first position engaging said fixed first electrical contact and a second position separated from said fixed first electrical contact;

f) an operating shaft having a first end and a second end, said shaft first end extending through said body second end and a portion of said central bore and coupled to said moveable second electrical contact for moving said movable second contact between said first and second positions;

g) sealing means composed of a material able to withstand the high voltages impressed on said fixed first electrical contact and said movable second electrical contact coupled to said operating shaft and at said sealing means outer periphery to the wall of said body defining said central bore to seal said second end of said body and prevent an arc between said first fixed electrical contact or said movable second electrical contact and said operating shaft second end; and h) mechanical means coupled to said second end of said operating shaft to selectively and directly position said movable second electrical contact with respect to said fixed first electrical contact.

2. A mechanically operated electrical switch as defined in claim 1, wherein said sealing means has a central aperture thorough which said operating shaft is passed.

3. A mechanically operated electrical switch as defined in claim 2, wherein said sealing means further comprises:

a) a first surface and a second surface; and b) a hub about said central aperture extending from both of said first and second surfaces.

4. A mechanically operated electrical switch as defined in claim 2, wherein said sealing means is chemically coupled to the surface of said operating shaft placed in said central aperture.

5. A mechanically operated electrical switch as defined in claim 4, wherein said outer periphery of said sealing means is chemically bonded to the wall of said body defining said central bore.

6. A mechanically operated electrical switch as defined in claim 4, wherein said outer periphery of said sealing means is press fit into said bore of said body.

7. A mechanically operated electrical switch as defined in claim 4, wherein said chemical coupling employs a bonding agent.

8. A mechanically operated electrical switch as defined in claim 2, wherein said sealing means is mechanically coupled to said operating shaft placed in said central aperture.

9. A mechanically operated electrical switch as defined in claim 8, wherein said outer periphery of said sealing means is chemically bonded to the wall of said body defining said central bore.

10. A mechanically operated electrical switch as defined in claim 8, wherein said outer periphery of said sealing means is press fit into said central bore of said body.

11. A mechanically operated electrical switch as defined in claim 8, wherein said mechanical coupling employs a ring compressed about said sealing means and said shaft.

12. A mechanically operated electrical switch as defined in claim 8, wherein said mechanical coupling employs an annular ring on said operating shaft to engage a first surface of said sealing means and a locking mechanism on said operating shaft to engage the second surface of said sealing means and said sealing means is compressed by said annular ring and said locking means as said locking means is applied to said operating shaft.

13. A mechanically operated electrical switch as defined in claim 12, wherein said sealing means is integrally formed with said switch body.

14. A mechanically operated electrical switch as defined in claim 1, wherein said sealing means is flexible and resilient.

15. A mechanically operated electrical switch as defined in claim 14, wherein said sealing means has a central aperture in which said operating shaft is placed.

16. A mechanically operated electrical switch as defined in claim 15, wherein said sealing means is chemically coupled to the surface of said operating shaft placed in said central aperture.

17. A mechanically operated electrical switch as defined in claim 16, wherein said sealing means is integrally formed with said switch body.

18. A mechanically operated electrical switch as defined in claim 16, wherein said outer periphery of said sealing means is chemically bonded to the wall of said body defining said central bore.

19. A mechanically operated electrical switch as defined in claim 16, wherein said outer periphery of said sealing means is press fit into said central bore of said body.

20. A mechanically operated electrical switch as defined in claim 19 wherein said sealing means further comprises:

a) a first surface and a second surface; and b) a hub about said central aperture extending from at least one of said first and second surfaces.

21. A mechanically operated electrical switch as defined in claim 20 wherein said first surface and said second surface from said central aperture to said outer periphery are parallel and linear.

22. A mechanically operated electrical switch as defined in claim 20 wherein said first surface and said second surface from said central aperture to said outer periphery are parallel and made up of segments which are curved and linear.

23. A mechanically operated electrical switch as defined in claim 22, wherein said first and second surfaces comprise:

a) a first linear segment perpendicular to said operating shaft extending outwardly from said central aperture;

b) a second linear segment perpendicular to said operating shaft extending inwardly from said outer periphery towards said central aperture, said second segment displaced along said operating shaft with respect to said first segment; and c) a curved segment joining said first and second linear segments.

24. A mechanically operated electrical switch as defined in claim 16, wherein said chemical coupling employs a bonding agent.

25. A mechanically operated electrical switch as defined in claim 15, wherein said sealing means is mechanically coupled to said operating shaft placed in said central aperture.

26. A mechanically operated electrical switch as defined in claim 25, wherein said sealing means is integrally formed with said switch body.

27. A mechanically operated electrical switch as defined in claim 25, wherein said outer periphery of said sealing means is chemically bonded to the wall of said body defining said central bore.

28. A mechanically operated electrical switch as defined in claim 25, wherein said outer periphery of said sealing means is press fit into said central bore of said body.

29. A mechanically operated electrical switch as defined in claim 25, wherein said mechanical coupling employs a ring compressed about said sealing means and said shaft.

30. A mechanically operated electrical switch as defined in claim 25, wherein said mechanical coupling employs an annular ring on said operating shaft to engage a first surface of said sealing means and a locking mechanism on said operating shaft to engage the second surface of said sealing means and said sealing means is compressed by said annular ring and said locking means as said locking means is applied to said operating shaft.

31. A mechanically operated electrical switch as defined in claim 1, wherein said sealing means is fabricated of a dielectric material to prevent arcing from said fixed first contact and said movable second contact to said mechanical means.

32. A mechanically operated electrical switch as defined in claim 31, wherein said sealing means has a central aperture in which said operating shaft is placed.

33. A mechanically operated electrical switch as defined in claim 32, wherein said sealing means is chemically coupled to the surface of said operating shaft placed in said central aperture.

34. A mechanically operated electrical switch as defined in 33, wherein said sealing means is integrally formed with said switch body.

35. A mechanically operated electrical switch as defined in claim 33 wherein said outer periphery of said sealing means is chemically bonded to the wall of said body defining said central bore.

36. A mechanically operated electrical switch as defined in claim 33, wherein said outer periphery of said sealing means press fit into said central bore of said body.

37. A mechanically operated electrical switch as defined in claim 33, wherein said chemical coupling employs a bonding agent.

38. A mechanically operated electrical switch as defined in claim 32, wherein said sealing means is mechanically coupled to said operating shaft placed in said central aperture.

39. A mechanically operated electrical switch as defined in claim 38, wherein said sealing means is integrally formed with said with said switch body.

40. A mechanically operated electrical switch as defined in claim 38, wherein said outer periphery of said sealing means is chemically bonded to the wall of said body defining said central bore.

41. A mechanically operated electrical switch as defined in claim 38, wherein said outer periphery of said sealing means is press fit into said central bore of said body.

42. A mechanically operated electrical switch as defined in claim 38, wherein said mechanical coupling employs a ring compressed about said sealing means and said shaft.

43. A mechanically operated electrical switch as defined in claim 38, wherein said mechanical coupling employs an annular ring on said operating shaft to engage a first surface of said sealing means and a locking mechanism on said operating shaft to engage the second surface of said sealing means and said sealing means is compressed by said annular ring and said locking means as said locking means is applied to said operating shaft.

44. A mechanically operated electrical switch as defined in claim 1, wherein said sealing means is integrally formed with said switch body.

45. A mechanically operated electrical switch as defined in claim 1, wherein said outer periphery of said sealing means is chemically bonded to the wall of said body defining said central bore.

46. A mechanically operated electrical switch as defined in claim 1, wherein said outer periphery of said sealing means is press fit into said bore of said body.

* * * * *